United States Patent [19]

Osika

[11] 4,419,554

[45] Dec. 6, 1983

[54] ELECTRIC SWITCHES FOR RECEIVING UNITARY INTERNAL CONTACT/WIRE TERMINAL ELEMENTS

[75] Inventor: Thomas F. Osika, Valparaiso, Ind.

[73] Assignee: McGill Manufacturing Company, Inc., Valparaiso, Ind.

[21] Appl. No.: 321,735

[22] Filed: Nov. 16, 1981

[51] Int. Cl.[3] ..... H01H 1/00

[52] U.S. Cl. ..... 200/284; 200/281; 339/147 R; 339/59 M

[58] Field of Search ..... 200/279, 280, 281, 284, 200/291; 339/59 R, 59 L, 59 M, 147 R, 147 P

[56] References Cited

U.S. PATENT DOCUMENTS

| | | | |
|---|---|---|---|
| 3,109,689 | 11/1963 | Cooney | 339/59 R |
| 3,209,109 | 9/1965 | Happe | 200/159 R |
| 3,312,930 | 4/1967 | Hatfield et al. | 339/147 P |
| 3,786,209 | 1/1974 | Bury | 200/284 X |
| 3,840,841 | 10/1974 | Clark | 339/147 P |
| 4,013,331 | 3/1977 | Kobler | 339/59 R |
| 4,085,989 | 4/1978 | McCardell | 339/59 M |
| 4,280,748 | 7/1981 | McHenney et al. | 339/147 R |
| 4,302,649 | 11/1981 | Ottersbach | 200/284 |
| 4,314,121 | 2/1982 | Gaber | 200/339 X |
| 4,352,965 | 10/1982 | Sorenson | 200/339 X |

FOREIGN PATENT DOCUMENTS

| | | | |
|---|---|---|---|
| 1589297 | 10/1969 | Fed. Rep. of Germany | 339/147 P |
| 1058278 | 2/1967 | United Kingdom | 339/59 M |

*Primary Examiner*—John W. Shepperd
*Assistant Examiner*—Renee S. Kidorf
*Attorney, Agent, or Firm*—Foorman L. Mueller

[57] ABSTRACT

An electric switch having an insulating housing and at least one opening into said housing from outside thereof, with a user inserted wire terminal insertable into said opening from the outside thereof and lockable coincidentally with such insertion, said wire terminal serving a first function of providing an internal switching contact within the switch and a second function of coupling the switch into an electric circuit.

6 Claims, 22 Drawing Figures

ELECTRIC SWITCHES FOR RECEIVING UNITARY INTERNAL CONTACT/WIRE TERMINAL ELEMENTS

BACKGROUND OF THE INVENTION

1. Field of the Invention

This invention relates generally to electric switches and more particularly to switches for lockably receiving user inserted dual-function elements which serve as wire terminals for coupling the switch into an electric circuit and provide the internal switching contacts of the switch.

2. Description of the Prior Art

A considerable variety of electric switch configurations have been devised for general purpose and special applications, and although these prior art switches vary in structural details, they usually include the same basic elements. Briefly, these switches have a dielectric switch case with a switch actuator, or toggle mechanism, mounted therein for pivotable movement into and out of electrically conductive engagement with metallic elements provided within the switch case. The metallic elements, which are riveted, crimped, or otherwise fixedly embedded in the switch case, are configured with internally disposed contact portions and have integral lugs which protrude from the switch case to provide external means for attachment of circuit wires to the switch.

This briefly described basic switch design is shown and more fully described in the following U.S. patents which are exemplary of the prior art. U.S. Pat. Nos. 3,158,704, 3,701,870, 4,101,479 and 4,268,734.

Although these particular prior art switches, and the large variety of similar switches, have proven satisfactory over the years, they have some shortcomings with regard to costs, reliability and ease of installation.

The manufacturing costs of these prior art switches are effected by the costs of the metallic elements per se and the assembly time needed to fixedly embed those elements in the switch casings.

As is known in the art, each mechanical junction in an electric circuit increases the electric resistance of the circuit and also increases the chances of circuit failure due to corrosion build up and the like. In the prior art switches, a minimum of two, and sometimes three mechanical junctions are required for each circuit wire that is connected to the switch. In some instances, bare wires are soldered, or otherwise attached directly to the extending lug portions of the switch's metallic elements and in such cases, two mechanical junctions are employed for each wire connection, namely, that used to connect the bare wire to the exposed lug, and the internal contact made within the switch case when it is opened and closed. In other, and more commonly used instances, the bared circuit wires are suitably joined to wire terminals which are in turn attached, such as with screw connections, frictional interconnection or the like, to the exposed lugs of the switch's metallic elements. Thus, in these latter cases, three mechanical junctions are used for each wire connection. Namely, the junction where the bared wire is connected to the wire terminal, the junction of the wire terminal to the exposed lug of the switch's metallic element, and the internal contact made within the switch case when it is operated.

With regard to prior art switch installation, in many instances, switches are mounted in areas where access to the back of the mounting panels is limited at best. In such situations, the otherwise relatively simple act of attaching circuit wires to the exposed lugs of the switch's metallic elements can be a frustrating task.

Therefore, a need exists for a new and improved electric switch which overcomes some of the shortcomings of the prior art.

SUMMARY OF THE INVENTION

In accordance with the present invention, new and improved electric switches are disclosed which are configured specifically to reduce manufacturing costs, increase switch reliability and facilitate installation. A switch casing formed of a suitable dielectric material is provided with a cavity in which a switch actuating means is mounted for manual manipulation between the open and closed positions of the switch. The switch case is also formed with at least one passageway which extends from the periphery of the case and opens into the cavity in which the switch actuator means is mounted. The passageway is configured to axially slidably receive a user inserted wire terminal which is suitably carried on the end of a circuit wire and position the wire terminal so that it extends into the cavity of the switch case proximate the switch actuating means so that the wire terminal serves the dual function of connecting the circuit wire to the switch and providing the internal contacts thereof.

The wire terminal and the passageway formed in the switch case are both of special configuration which provide cooperating elements of a lockable interconnection, so that once the wire terminal is inserted into the switch case, a frictional interlock therebetween exists which prevents accidental or other unintentional retraction of the wire terminal from the switch case.

With the switch of the present invention being configured as described above, it will be readily seen that switch costs are reduced, in that the prior art embedded metallic elements and the cost of their installation within the switch case are eliminated. Further, the number of mechanical junctions is minimized which reduces overall circuit resistance and the chance for circuit malfunction due to junction failures. Such connection of circuit wires to the switch case involve the operation of simply sliding the wire terminals into the passageway of the switch case and this is a user accomplished operation. Therefore, switch installation is facilitated in comparison to many, if not most, of the prior art switches.

It is to be understood that the basic concept of the present invention is not limited to any particular type of switch in that the concept may be utilized with grounding switches, single pole single throw switches, single pole double throw switches and the like.

Accordingly, it is an object of the present invention to provide new and improved electric switches.

Another object of the present invention is to provide new and improved electric switches of minimal costs, increased reliability and simplified user installation.

A more specific object of the present invention is to provide a switch case having switch actuator means therein and which is configured to lockably receive user installed wire terminals which accomplish the dual functions of providing the switch case with internal switching contacts and connecting circuit wires to the switch.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
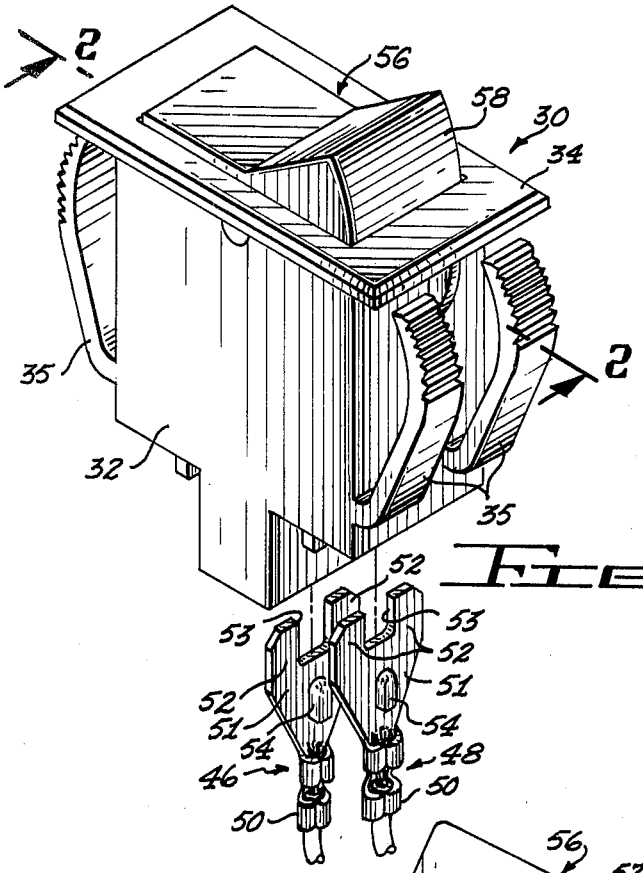
FIG. 1 is a perspective view of a first type of switch which is configured in accordance with the principles of the present invention and has a pair of special dual-function wire terminals shown in exploded relationship therewith.

Referring more particularly to the drawings, wherein FIG. 1 best illustrates the first embodiment of the switch of the present invention which is indicated in its entirety by the reference numeral 30. As shown, the switch 30 is more or less conventional with regard to its outward appearance and includes a switch casing 32 which is molded or otherwise formed of a suitable resilient dielectric material. The switch casing is of generally box-shaped configuration having a cavity 33 formed therein which opens into an end surface which will be hereinafter referred to as the front surface of the casing with the front surface having a laterally extending endless flange 34 which defines the periphery thereof. The flange 34 is provided for bearing engagement with the outwardly facing surface of a panel (not shown) in which the switch is to be installed so that the main body portion of the switch casing 32 extends through an aperture provided for that purpose in the panel. The switch casing is further provided with resiliently deflectable arms 35 extending integrally from the opposite sides thereof which frictionally grip the edges of the panel aperture to firmly mount the switch 30 therein in a manner well known in the art.

Figure 2:
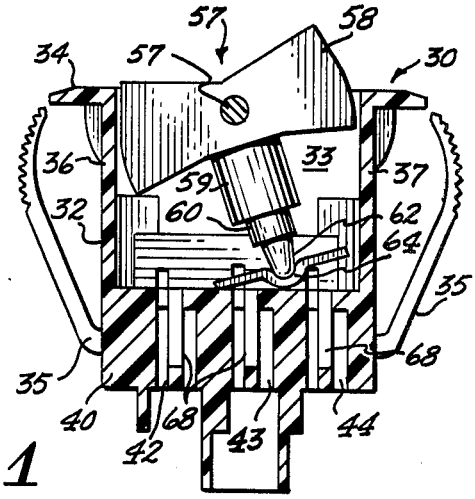
FIG. 2 is a sectional view taken along the line 2—2 of FIG. 1 and showing the internal configuration of the switch prior to user installation of the special dual-function wire terminals therein.
Figure 3:
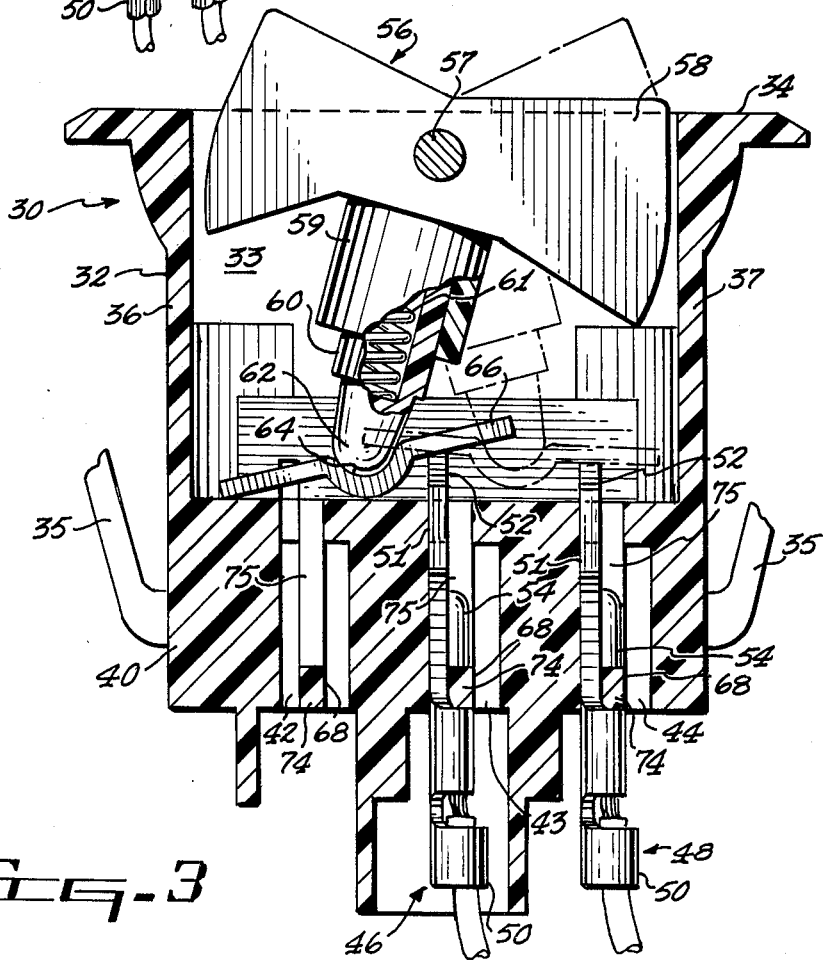
FIG. 3 is an enlarged sectional view similar to FIG. 2 and showing the switch with the dual-function wire terminals installed therein.
Figure 5:
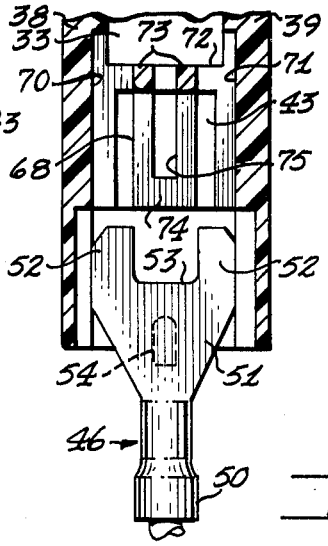
FIG. 5 is a fragmentary sectional view taken on the line 5—5 of FIG. 4.
Figure 7:
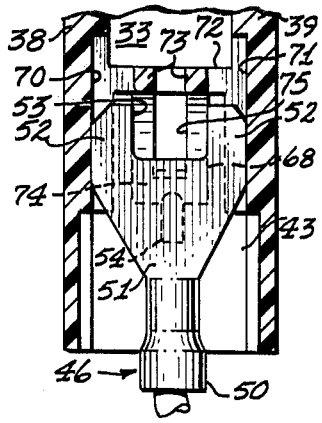
FIG. 7 is a fragmentary sectional view taken along the line 7—7 of FIG. 6.
Figure 9:
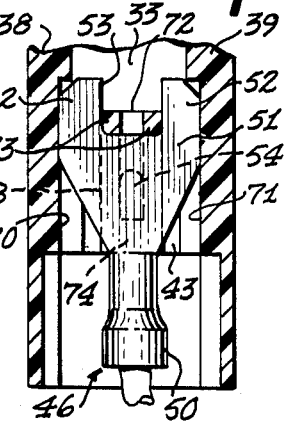
FIG. 9 is a fragmentary sectional view taken along the line 9—9 of FIG. 8.
Figure 10:
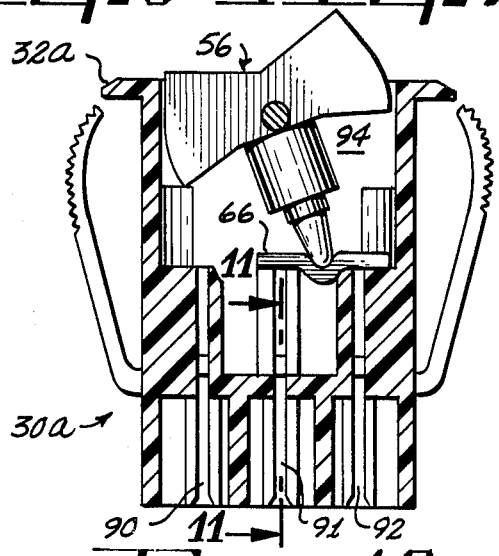
FIG. 10 is a sectional view similar to FIG. 2 showing a switch of the same basic type which is of modified configuration.

The cavity 33 provided in the switch casing 32 is open at its top, as viewed in FIGS. 2 and 3, with the sides of the cavity being defined by opposed end walls 36 and 37 and opposed sidewalls 38 and 39, which are shown best in FIGS. 5, 7 and 9. The switch casing is formed with a relatively thick bottom wall 40 with the inwardly disposed surface thereof being the bottom surface of the cavity 33 and the outwardly disposed surface forming the back surface of the switch casing.

As will hereinafter be described in detail, plural passageways 42, 43 and 44 of special configuration are formed through the bottom wall 40 of the switch casing 32 so as to open onto the bottom surface of the cavity 33 and onto the back surface of the switch casing. Each of the plural passageways 42, 43 and 44 are designed to receive special dual-function wire terminals, with the switch 30 of this embodiment being shown as having one of those terminals 46 inserted into the passageway 43 and another identical terminal 48 inserted into the passageway 44.

As best seen in FIG. 1, the special wire terminals 46 and 48 are attached to circuit wires as at 50 in a conventional manner such as by crimping. The wire terminals each have a planar blade portion 51 which extends from the circuit wire junction end 50 and is formed with a bifurcated distal end to provide a parallel pair of arms 52 with a U-shaped opening 53 therebetween, and the planar blade portion 51 of each wire terminal is provided with a normally extending latching lug 54. The arms 52 at the distal end of the planar blade 51 of each of the wire terminals serves as the internal electric switching contacts of the switch 30, and the latching lugs 54 are employed to lockably secure the wire terminals in the passageways of the switch case.

When the wire terminals 46 and 48 are lockably positioned in the switch case 32, in a manner which will hereinafter be described in detail, they are positioned so that the arms 52 of the terminals extend from their respective passageways 43 and 44 into the cavity 33 of the switch casing 32 in the manner shown best in FIG. 3, and the extending arms form the internal switching contacts of the switch 30 as hereinbefore mentioned.

A switch actuating means 56, in the illustrated form of a toggle mechanism, is mounted in the cavity 33 of the switch casing 32. The toggle 56 is movably mounted in the casing 32 such as by a suitable pivot pin 57 and has an operator portion 58 which is disposed at the open end of the cavity 33 to provide the toggle with means by which it is manually manipulatable. An operating means extends from the operator 58 and includes a tubular boss 59 which extends from the operator 58 into the cavity 33 and a control pin, or plunger, 60 is telescopically disposed therein and is biased by means of the spring 61 so as to yieldably extend axially from the open lower end of the tubular boss. The control pin 61 is formed with a rounded extending end 62 which is biased into bearing engagement with an arcuate recess 64 formed intermediate the opposite ends of a movable bridging contact, or lever 66. A complete discussion of the operation of the toggle 56 and the bridging contact 66 is deemed to be unnecessary in view of the well known conventional aspects of this portion of the disclosure. However, to insure a complete understanding, the operation will be briefly discussed. The toggle 56 is fabricated of a dielectric material, such as Bakelite or nylon, and its only function is to move the bridging contact 66, which is formed of electrically conductive material, rectilinearly from the solid line position to the dashed line position shown in FIG. 3. The solid line position constitutes the open position of the switch 30 in that one end of the bridging contact 66 is in bearing engagement with the wire terminal 46 and its other end is resting on the bottom surface of the cavity 33. When the toggle 56 is manually pivoted to the dashed line position, it will move the bridging contact 66 so that it is in electrically conductive contact with both of the wire terminals 46 and 48 and this, of course, will complete the circuit between those terminals and is therefore the closed position of the switch 30.

As hereinbefore mentioned, the wire terminals 46 and 48 are user installed items, and the switch case 32 and the wire terminals are of special configuration, so that when the terminals are installed, they will be locked in the passageways of the switch casing. The special configurations of the switch casing 32 and the wire terminals 46 and 48 constitute cooperating elements of a lockable interconnection, with the above described latching lugs 54 of the wire terminals being one of the cooperating elements. The other element of the cooperating elements of the lockable interconnection are in the form of a resiliently deflectable latching member 68 formed within each of the passageways 42, 43 and 44 of the switch casing 32.

Referring now in particular to FIGS. 4 through 9 wherein the structural details of the passageway 43 and its latching member 68 are best seen, with it being understood that the following description thereof also applies to the other passageways 42 and 44 and their respective latching members 68.

As seen best in FIG. 5, the passageway 43 is somewhat wider in comparison to the width dimension of the cavity 33 and thus forms guide channels 70 and 71 in the opposed sidewalls 38 and 39 of the switch casing 32. A cross member 72 extends longitudinally across the passageway 43 and transversely protrudes part way across the opening thereof. A spaced pair of stops 73 extend integrally and laterally from the cross member and the resiliently deflectable latching member 68 depends integrally therefrom. The latching member 68 is a substantially U-shaped cantilever member having a bight portion 74 on its depending end below a central opening 75 formed through the latching member.

Figure 4:
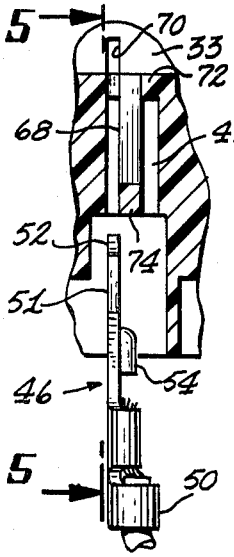
FIG. 4 is a fragmentary sectional view taken along the same plane as FIGS. 2 and 3 and showing one of the wire terminal receiving passageways of the switch casing with one of the dual-function wire terminals in a position wherein the terminal is just starting to be inserted therein.
Figure 6:
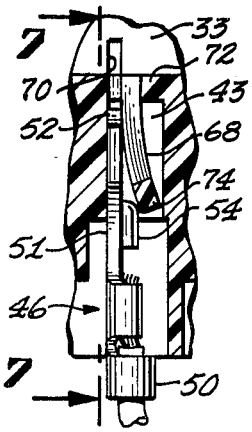
FIG. 6 is a fragmentary sectional view similar to FIG. 4 with the wiring terminal being shown as having been moved so that it is about half way inserted into the wire terminal receiving passageway of the switch casing.
Figure 8:
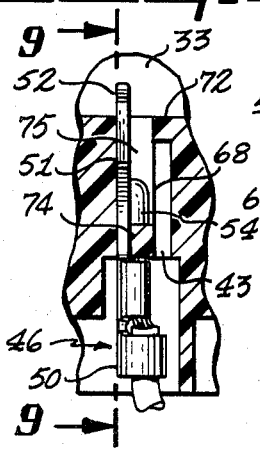
FIG. 8 is a fragmentary sectional view similar to FIGS. 4 and 6 with the wiring terminal being shown in the fully inserted position.

To install the wire terminal 46 in the passageway 43, the terminal is positioned as shown in FIGS. 4 and 5 just inside the bottom of the passageway. When the wire terminal 46 is axially slidably moved into the passageway 43, as shown in FIGS. 6 and 7, to an intermediate position, the opposite side edges of the planar blade portion 51 of the wire terminal will lightly bear against the bottoms of the guide channels 70 and 71, and the rounded upper edge of the latching lug 54 will bear against the bight portion 74 of the latching member 68 and deflect it in the manner shown. When fully inserted, as shown in FIGS. 8 and 9, the latching lug 54 of the wire terminal 46 is moved past the bight portion 74 into the central opening 75 of the latching member 68 which removes the deflecting force therefrom and allows the inherent resiliency of the latching member to return it to its normal position. When returned to its normal position, the bight portion 74 will be located immediately below the flat bottom trailing end of the latching lug 54 of the wire terminal 46 thus locking the wire terminal in the fully inserted position. The bottom surface of the U-shaped opening 53 formed in the bifurcated distal end of the wire terminal is in engagement with the stops 73 to limit axial movement in the direction of insertion, with the bight portion 74 of the resiliently deflectable latching member 68 preventing axial retraction of the wire terminal. Lateral movement of the inserted wire terminal 46 is prevented by the guide channels 70 and 71 in which the opposite side edges of the planar blade portion 51 of the wire terminal are restrainingly contained.

Referring now to FIGS. 10 through 13 wherein a modified version of the above described electric switch 30 is shown with the modified switch being indicated in its entirety by the reference numeral 30*a*. The switch 30*a* operates in the same manner as described above with regard to the switch actuator means 56 and the movable bridging contact 66, with the difference between the switches 30 and 30*a* being in the switch casing 32*a* which is modified to lockably receive user installed dual-function wire terminals 76 and 78 which differ in design detail from the previously described wire terminals 46 and 48.

The wire terminals 76 and 78 are crimpingly attached as at 80 to the circuit wires and have a planar blade portion 81 which extends from the end 80 to its distal end which is bifurcated and is thus provided with the spaced pair of arms 82 which serve as the internal switching contacts of the switch 30*a* in the manner hereinbefore described. The width dimension of the blade portion 81 of the wire terminals is somewhat larger at the end thereof which is opposite the bifurcated distal end to provide an opposed pair of laterally extending tabs 83 and 84 which serve as stop members to limit axial insertion of the wire terminals into the switch case 32*a*. The planar blades 81 of the wire terminals 76 and 78 are each provided with an aperture 85 and, as shown in the terminal 76 in FIGS. 11 and 12, a channel 86 extends tangentially from the aperture and opens onto one of the side edges of the planar blade 81 immediately adjacent the laterally extending stop tab 83 of that side edge. As seen in FIG. 12, that same side edge of the terminal's blade portion 81 is formed with a bearing surface 87 which slopes outwardly and angularly from the side edge of the blade 81 toward the end 80 thereof, with the portion of the blade 81 which lies between the bearing surface 87 and the aperture 85 forming a resiliently deflectable latching lug 88.

The switch casing 32*a* is provided with plural passageways 90, 91 and 92 therein which extend from the back surface of the casing into the cavity 94 of the switch casing. The passageways are internally configured to lockably receive the above described wire terminals 76 and 78, and to achieve this objective, the passageways 90, 91 and 92 and the wire terminals 76 and 78 are provided with cooperative elements of a lockable interconnection. One of these cooperative elements is provided by the above described resiliently deflectable latching lugs 88 of the wire terminals with the other cooperative element being in the form of a latching ledge 96 provided in the passageways, with each of those latching ledges defining a latching surface which faces toward the cavity 94.

Figure 11:
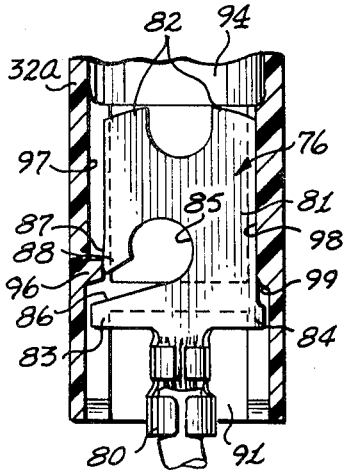
FIG. 11 is an enlarged fragmentary sectional view taken along the line 11—11 of FIG. 10 and showing a different configuration of dual-function wire terminal as being partway inserted into one of the wire terminal receiving passageways of the switch casing.
Figure 12:
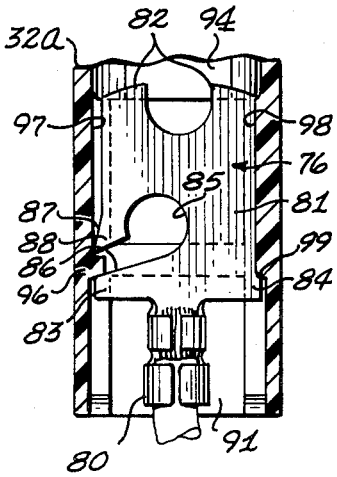
FIG. 12 is a fragmentary sectional view similar to FIG. 11 but showing the wiring terminal as being fully inserted into the switch casing.
Figure 13:
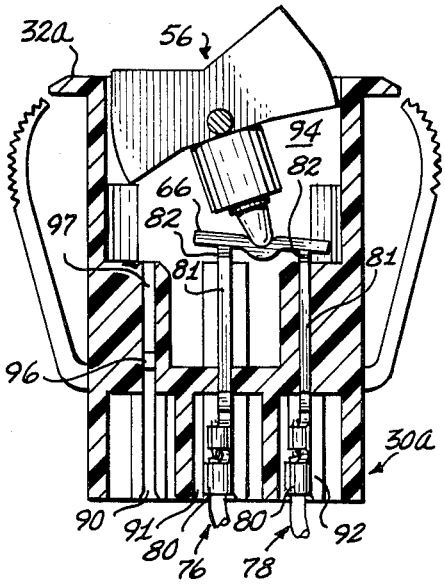
FIG. 13 is a sectional view similar to FIG. 10 with a pair of the special dual-function wire terminals inserted therein.

As shown in FIGS. 11 and 12, wherein the typical passageway 91 and the wire terminal 76 are shown, the passageway 91 is somewhat wider than the cavity 94 to form opposed guide channels 97 and 98 for slidably receiving the opposite side edges of the blade portion 81 of the wire terminal. The above mentioned latching ledge 96 is provided so as to extend into the guide channel 97 and a stop shoulder 99 is alignigly provided in the opposite guide channel 98. When the wire terminal 76 is being installed by the user of the switch 30*a*, it is positioned as shown in FIG. 11 and the insertion movement will bring the bearing surface 87 of the wire terminal's blade portion 81 into engagement with the latching ledge 96 of the passageway 91. Such engagement will deflect the latching lug 88 toward the aperture 85 to permit passage of the latching lug 88 past the latching ledge 96. Further axial insertion movement of the wire terminal 76 into the passageway will move the latching lug 88 past the latching ledge 96 and this removes the deflecting force from the latching lug and its inherent resiliency will move it back into its normal position as shown in FIG. 12. When fully inserted in this manner, the extending end of the latching lug 88 will be in bearing engagement with the latching surface of the latching ledge 96, and the stop tabs 83 and 84 will be in respective bearing engagement with the bottom surface of the latching ledge 96 and the stop shoulder 99 provided in the passageway. This will prevent any further axial movement, either in the direction of insertion or in the direction of retraction, and lateral deflection of the wire terminal 76 is prevented by the opposed guide channels 97 and 98 in which the opposite side edges of the wire terminal are captively retained.

Referring now to FIGS. 14 through 22 wherein another type of electric switch is shown as being configured in accordance with the principles of the present invention, with this switch being indicated generally by the reference numeral 100. The switch 100 is of the type commonly referred to as a grounding switch, in that it is employed to open or complete a ground circuit, such as for termination of the operation of an internal combustion engine by grounding of its ignition circuit. Since the switch 100 is a grounding switch, in many instances it will have a single, or principal, grounding wire 101 (FIG. 21) attached thereto and when the switch is manually manipulated to its grounding position, the grounding wire 101 is electrically connected to the metallic switching actuator means 102 so that the grounding circuit is made through the metallic panel (not shown) in which the switch is mounted. In other instances, such as when the switch 100 is mounted in a panel (not shown) which is fabricated of a dielectric material, a secondary, or remote, grounding wire 103 (FIG. 22) is attached to the switch 100 for remote grounding purposes.

Figure 19:
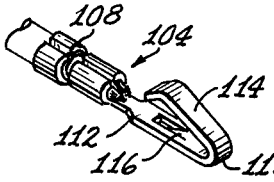
FIG. 19 is a perspective view of a first type of dual-function wire terminal suitable for use in the switch of FIGS. 14 and 15.
Figure 20:
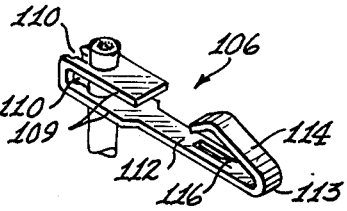
FIG. 20 is a perspective view of a second type of dual-function wire terminal suitable for use in the switch of FIGS. 14 and 15.

As will hereinafter be described in detail, the principal ground wire 101, and the remote ground wire 103 when used, may be provided with a wire terminal 104 as seen best in FIG. 19, or may alternately be provided with the wire terminal 106 as shown in FIG. 20.

The wire terminals 104 and 106 are both user inserted dual-function wiring terminals, in accordance with the principles of the present invention, with the only differences therebetween being the manner in which they are fixedly attached to the ground wires. The wire terminal 104 is axially disposed with respect to a wire and is attached thereto in a conventional manner, such as by crimping as at 108. The wire terminal 106 is attached to the end of an insulated wire in transverse relationship with respect to the axis of the wire. The wire terminal 106 is folded back on itself at its wire connection end to provide a spaced pair of arms 109. Each of the arms 109 are formed with a channel/aperture opening 110 therein, and those openings are sized and configured to provide an interference fit so that when the wire is wedgingly forced into the openings, the insulation of the wire will be sliced, or pierced, so that the metallic conductor (not shown) of the wire will be in electrically conductive contact with the wire terminal 106.

As noted, the distal ends of the wire terminals 104 and 106 are identical, and the following description of the distal end of the wire terminal 104 will be understood to also apply to the distal end of the wire terminal 106. The wire terminal 104 is provided with a planar body portion 112, which extends from its wire junction end 108, and its extending end is folded back as at 113 to provide a rearwardly upwardly and angularly sloping contact portion 114. The wire terminal is fabricated of a suitable electrically conductive material, such as beryllium copper, phosphor bronze, or the like, and the inherent nature of this type of material is such that the contact portion 114 is resiliently deflectable. The planar body portion 112 of the wire terminal 104 is cut, stamped, or otherwise formed to provide a downwardly rearwardly and angularly sloping latching lug 116 for purposes which will hereinafter be described in detail.

Figure 17:
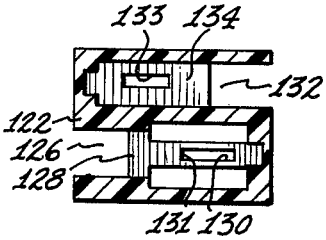
FIG. 17 is an enlarged sectional view taken along the line 17—17 of FIG. 14 and showing the internal configuration of the switch casing on a second plane.
Figure 21:
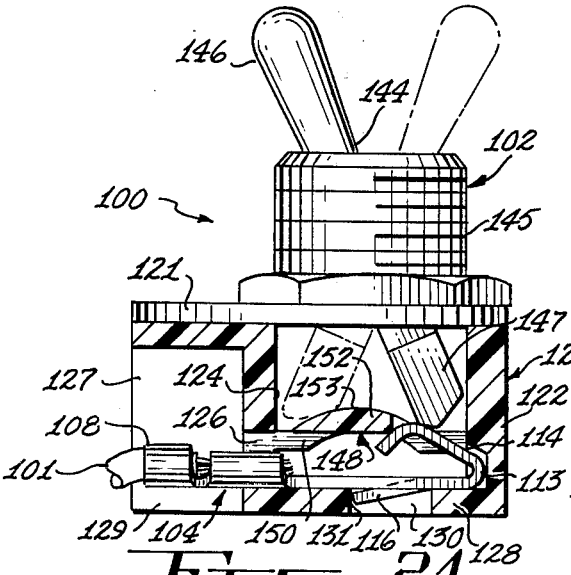
FIG. 21 is an enlarged sectional view taken along the line 21—21 of FIG. 15 and having the dual function wire terminal of FIG. 19 inserted in the first wire terminal receiving passageway of the switch casing.

The switch 100 includes a switch casing 120 formed of a suitable dielectric material, and which is configured to provide a planar top wall 121 and an integral main body portion 122. The main body portion 122 is formed with a cavity 124 therein which opens onto the top surface of the top wall 121. A first passageway 126 extends through the sidewall of the switch body 122 and opens into the cavity 124. The passageway 126 is open as at 127 to allow axial user insertion of the wire terminals 104 or 106, and the outwardly disposed end of its bottom wall 128 is open as at 129 to accommodate the wire which is transverse with respect to the wire terminal 106 in the event of use of that particular type of terminal. The passageway 126 has a stop surface opposite the open end 126 thereof to limit axial insertion of the wire terminal and, the bottom wall 128 of the first passageway, as seen best in FIG. 17, is provided with a latching slot 130 having a latching surface 131 which lockably receives the latching lug 116 of the wire terminal 104, or 106, as shown in FIG. 21 when the wire terminal is axially inserted in the passageway 126. Thus, the wire terminal 104, or 106, and the passageway 126 of the switch 100 are provided with cooperative elements of a lockable interconnection.

Figure 22:
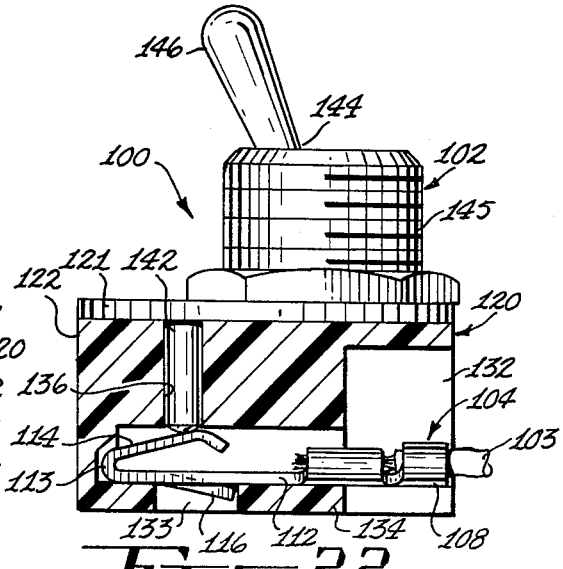
FIG. 22 is an enlarged sectional view taken along the line 22—22 of FIG. 15 and having the dual-function wire terminal inserted in the second wire terminal receiving passageway of the switch casing.
Figure 23:
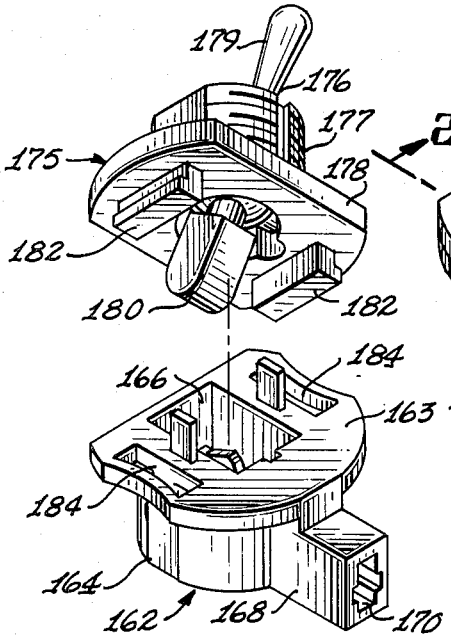
FIG. 23 is a perspective view of a third type of switch which is configured in accordance with the principles of the present invention with the switch actuator means being shown in exploded relationship with respect to the switch casing.

The main body portion 122 of the switch 100 is provided with a second passageway 132 for axially receiving the wire terminal 104, or 106, on the remote grounding wire 103 when that remote grounding wire is needed as dictated by switch installation requirements. The second passageway 132 is provided with a stop surface therein similar to the above described passage 126, and is provided with a latching slot 133, defining a latching surface as hereinbefore described in its bottom wall 134 which cooperatively interacts with the latching lug 116 of the wire terminal on the end of the remote grounding wire 103 as shown in FIG. 22.

A bore 136 is formed in the switch body portion 122 so as to communicate between the second passageway 132 and the upper surface of the planar top wall 121 of the switch casing.

Figure 14:
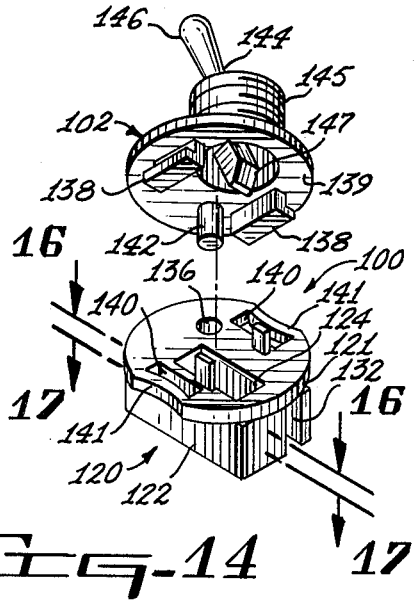
FIG. 14 is a perspective view of a second type of switch which is configured in accordance with the principles of the present invention and is shown with the switch actuator means being in exploded relationship with the switch casing.
Figure 15:
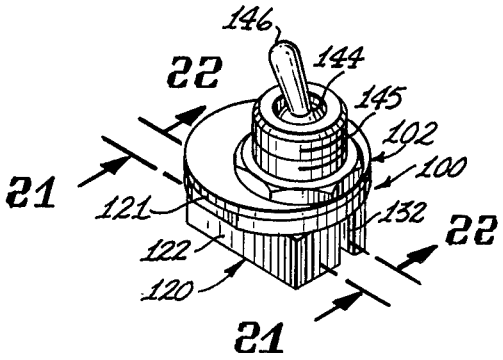
FIG. 15 is a perspective view similar to FIG. 14 and showing the switch actuator means as being assembled to the switch casing.
Figure 18:
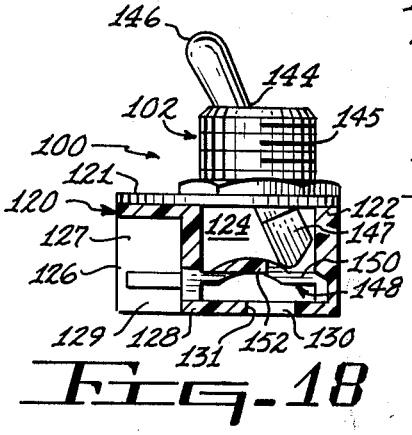
FIG. 18 is a vertical section taken through the switch of FIGS. 14 and 15 to illustrate the structural details of a first wire terminal receiving passageway of the switch casing.

As shown in FIG. 14, the switch actuator means 102 is provided with a spaced pair of L-shaped locking tabs 138 which depend in spaced relationship from the bottom surface 139 thereof. The locking tabs 138 are used to fixedly mount the switch actuator means 102 on the switch casing 120 by passing through aligned slots 140 provided in the planar top wall 121 of the switch casing 120, and being frictionally held therein by means of the resiliently deflectable members 141 which define one of the longitudinal edges of the slots 140. A cylindrical pin 142 also depends integrally from the bottom surface 139 of the switch actuator means 102 and the pin passes downwardly through the bore 136 of the switch casing 120 and extends into the second passageway 132 into electrically conductive contact with the contact portion 114 of the wire terminal 104, or 106, in the manner shown in FIG. 22.

The switch actuator means 102 is shown in the form of a conventional toggle mechanism having an actuating lever, or bat 144, pivotably carried in an externally threaded tubular boss 145 in the well known manner. The bat 144 has the usual handle end 146 extending from the boss by which the toggle mechanism is manually manipulatable, and has a switch operating end 147 which extends oppositely from the boss 145 into the cavity 124 of the switch casing 120. The bat 144 is pivotably movable between a grounding position shown in solid lines in FIG. 21 and an open position shown in dashed lines in the same figure. When in the grounding position, the operating end 147 of the bat 144 is in electrically conductive engagement with the resiliently deflectable sloping contact portion 114 of the wire terminal 104, or 106, which extends upwardly from the first passageway 126 into the bottom end of the cavity 124. When the switch 100 is to be opened, movement of the bat 144 from the solid line position to the dash line position will movingly deflect the contact portion 114 of the wire terminal downwardly toward the passageway 126 and the operating end 147 will move into engagement with a resiliently deflectable bat retainer means 148 which is employed to yieldably hold the bat in the open, or dash line position, thereof.

Figure 16:
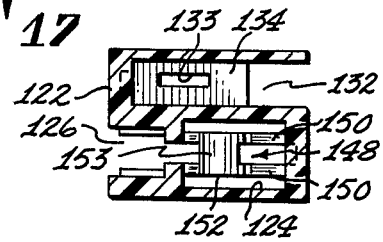
FIG. 16 is an enlarged sectional view taken along the line 16—16 of FIG. 14 to show the internal configuration of the switch casing on a first plane.

As seen best in FIG. 16, the toggle retainer means 148 includes a spaced pair of beam members 150 which are integrally formed with the main body portion 122 of the switch casing 120 and are disposed between the cavity 124 and the first passageway 126. The beam members 150 have an integral cam member 152 formed transversely thereof intermediate the opposite ends of the beams. As seen best in FIG. 21, the cam member 152 is configured with an arcuate cam surface 153 which faces into the cavity 124 of the switch casing 120. When the bat 144 is moved to its dash line position, the operating end 147 will exert a force on the arcuate cam surface 153 of the toggle retainer means 148 and this results in deflection thereof toward the first passageway 126. When the operating end 147 of the bat 144 passes beyond the crown of the arcuate cam surface 152, it will come to rest in the position shown in dashed lines, and will be yieldably held in that position by frictional engagement of the operating end 147 of the bat 144 and the cam member 152.

From the above description, it will be seen that when the switch 100 is mounted in an electrically conductive panel (not shown) and the switch actuator means 102 is in the grounding position, the ground path is from the wire terminal 104, or 106, to the bat 144 via the sloping contact portion 114 of the wire terminal, and through the bat to the boss 145 and from the boss to the electrically conductive mounting panel. When the switch 100 is mounted in a panel (not shown) of dielectric material, the ground path through the switch is essentially the same with the exception that the path to ground is through the cylindrical pin 142 of the switch actuator means 102 to the wire terminal 104, or 106, of the remote grounding wire 103.

Figure 24:
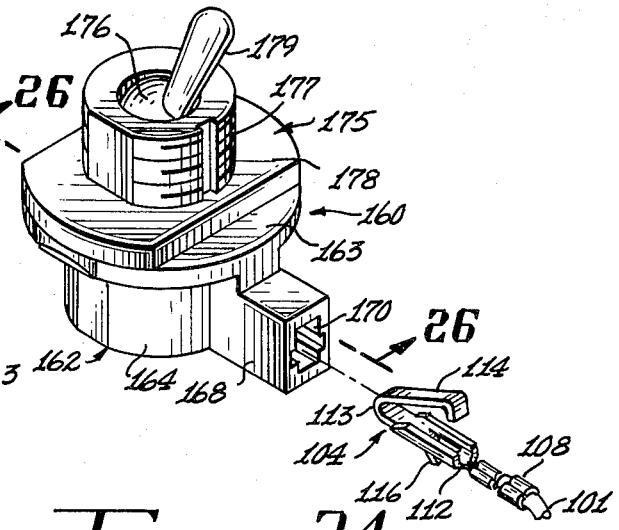
FIG. 24 is a perspective view similar to FIG. 23 and showing the switch actuator means as being assembled to the switch casing and showing a dual-function wire terminal in exploded relationship therewith.
Figure 26:
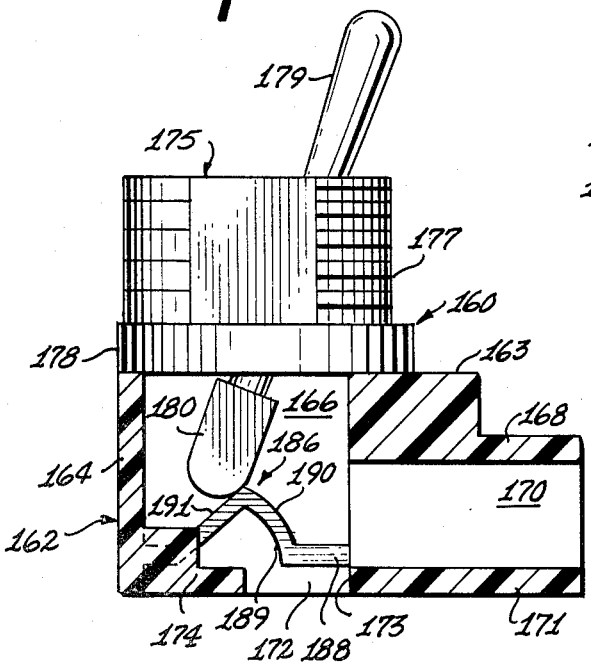
FIG. 26 is an enlarged sectional view taken along the line 26—26 of FIG. 24 to show the internal switch casing configuration.

Referring now to FIGS. 23 through 27 wherein another electric switch of the hereinbefore described grounding switch type is shown, with the switch of this embodiment being indicated generally by the reference numeral 160. As will become apparent as this description progresses, the switch 160 is not configured to provide a remote grounding capability and is therefore designed to receive the user inserted principal grounding wire 101 only. The ground wire 101 is shown in FIG. 24 as having the dual-function wire terminal 104 fixedly attached thereto, and thus it is deemed unnecessary to repeat the detailed description of that wire terminal.

The switch 160 includes a switch casing 162 formed of dielectric material, and is configured with a planar top wall 163 and an integral main body portion 164. A cavity 166 is formed in the switch body 164 and opens onto the top surface of the planar top wall 163. A boss 168 extends laterally and integrally from the switch body 164 and a passageway 170 is formed through the boss 168 so as to open into the cavity 166 of the switch body. The bottom wall 171 of the passageway 170 is provided with a latching slot 172, defining the latching surface 173, for lockably receiving the latching lug 116 of the wire terminal 104 when it is axially inserted therein. Thus, in the manner hereinbefore described with reference to the switch 100, the wire terminal 104 and the passageway 170 of the switch casing 162 are provided with cooperative elements of a lockable interconnection. A stop member 174 is formed in the innermost end of the passageway 170 for engaging the wire terminal 104 to define the fully inserted position thereof.

The switch actuator means 175 of the switch 160 is similar to the previously described switch actuator means 102. The switch actuator means 175 is shown as a conventional toggle mechanism formed of electrically conductive material with the actuator lever, or bat 176 pivotably carried within an externally threaded tubular boss 177 which extends normally from a planar mounting plate 178, and the bat 176 has the handle end 179 and the operating end 180 extending oppositely from the boss 177. The switch actuating means 175 is fixedly mounted on the switch casing 162 by means of the L-shaped locking tabs 182 which depend integrally from the mounting plate 178 for frictional engagement within the slots 184 aligningly provided in the planar top wall 163 of the switch casing 162.

Figure 25:
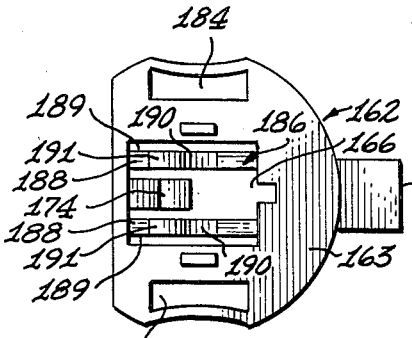
FIG. 25 is a plan view showing the top of the switch casing of the switch shown in FIGS. 24 and 25.
Figure 27:
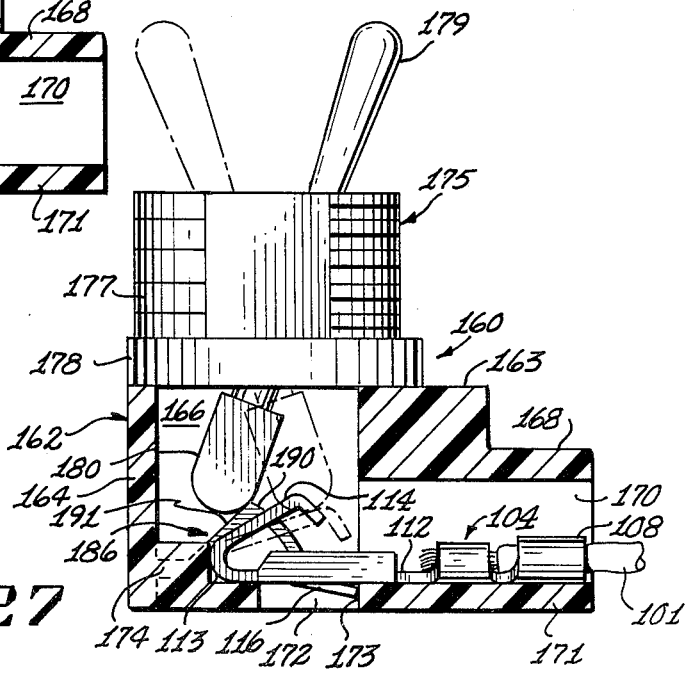
FIG. 27 is an enlarged sectional view similar to FIG. 26 and showing the internal configuration of the switch casing with the dual-function wire terminal inserted therein.

With the switch actuator means 175 mounted on the switch casing 162 in the above described manner, the operating end 180 of the bat 176 extends into the cavity 166 of the switch casing 162 and is pivotably movable between an open position shown in solid lines in FIG. 27 and a grounding position shown in dashed lines in the same figure. When in the open position, the bat 176 is yieldably retained in that position by a resiliently deflectable toggle retainer means 186, which is integrally formed in the switch casing 162. As seen in FIG. 25, the bat retainer means 186 is in the form of a spaced apart pair of beam members 188 each of which is configured to provide an intermediate cam member 189 as seen best in FIG. 26.

When the user inserted wire terminal 104 is lockably received in the passageway 170, the sloping contact portion 114 thereof extends into the cavity 166 so as to be in electrically conductive engagement with the operating end 180 of the bat 176. When the switch actuating means 175 is manually manipulated to the open position, the operating end 180 of the bat 176 will move into engagement with the arcuate cam surfaces 190 of the cam members 189 to deflect the retainer means 186 and when moved past the apex of the cam members 189, the operating end 180 will be held in the open, or solid line position, by virtue of its being in engagement with the surfaces 191 of the cam member.

The ground path of the switch 160 is similar to the primary ground path of the switch 100. Thus, when the switch 160 is in its grounding position, the ground path is from the wire terminal 104, through the bat 176, through the threaded boss 177 to the electrically conductive mounting panel (not shown) in which the switch is mounted.

While the principles of the invention have now been described in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An electric switch for receiving at least one user inserted wire terminal which couples said electric switch into an electric circuit and provides a switch contact within said electric switch comprising:

(a) a switch casing having a cavity and at least one passageway which extends from the periphery of said switch casing and opens into said cavity;

(b) a wire terminal one end of which defines a switch contact portion, said wire terminal slidably insertable into said passageway of said switch casing to a position which places said switch contact portion thereof within said cavity of said switch casing;

(c) cooperative elements of a lockable interconnection within said passageway of said switch casing and on said wire terminal for lockably retaining said wire terminal within said passageway of said switch casing when said wire terminal is slidably inserted therein;

(d) said wire terminal having a planar body portion with a resiliently deflectable latching lug extending from one of the side edges thereof;

(e) a latching ledge integral with said switch casing and having a latching surface, said latching ledge extending into said passageway of said switch casing, said latching ledge exerting a deflecting force on said latching lug of said wire terminal during slidable insertion thereof into said passageway and removing that deflecting force when said wire terminal is fully inserted therein to allow said latching lug of said wire terminal to resiliently move into latching engagement with the latching surface of said latching ledge; and (f) switch actuating means having a movable operating means disposed within said cavity of said switch casing and movable into and out of electrically conductive contact with said switch contact portion of said wire terminal when said wire terminal is inserted into said passageway of said switch casing and maintained therein.

2. An electric switch for receiving at least one user inserted wire terminal which couples said electric switch into an electric circuit and provides a switch contact within said electric switch comprising:

(a) a switch casing having a cavity and at least one passageway which extends from the periphery of said switch casing and opens into said cavity;

(b) a wire terminal one end of which defines a switch contact portion, said wire terminal slidably insertable into said passageway of said switch casing to a position which places said switch contact portion thereof within said cavity of said switch casing;

(c) cooperative elements of a lockable interconnection within said passageway of said switch casing and on said wire terminal for lockably retaining said wire terminal within said passageway of said switch casing when said wire terminal is slidably inserted therein;

(d) said wire terminal having a planar body portion with a resiliently deflectable latching lug extending from one of the side edges thereof;

(e) a latching ledge integral with said switch casing and having a latching surface, said latching ledge extending into said passageway of said switch casing, said latching ledge exerting a deflecting force on said latching lug of said wire terminal during slidable insertion thereof into said passageway and removing that deflecting force when said wire terminal is fully inserted therein to allow said latching lug of said wire terminal to resiliently move into latching engagement with the latching surface of said latching ledge;

(f) said passageway of said switch casing having opposed sidewalls and a pair of elongated guide channels, each guide channel being formed in a corresponding opposed sidewall and disposed to open inwardly into said passageway, said pair of guide channels each disposed to receive a different opposite side edge of said planar body portion of said wire terminal for guiding movement of said wire terminal during insertion thereof and to subsequently prevent lateral movement of said wire terminal, said latching ledge being disposed in one of said pair of guide chanels; and (g) switch actuating means having a movable operating means disposed within said cavity of said switch casing and movable into and out of electrically conductive contact with said switch contact portion of said wire terminal when said wire terminal is inserted into said passageway of said switch casing and maintained therein.

3. An electric switch for receiving at least one user inserted wire terminal which couples said electric switch into an electric circuit and provides a switch contact within said electric switch comprising:

(a) a switch casing having a cavity and at least one passageway which extends from the periphery of said switch casing and opens into said cavity;

(b) a wire terminal one end of which defines a switch contact portion, said wire terminal slidably insertable into said passageway of said switch casing to a position which places said switch contact portion thereof within said cavity of said switch casing;

(c) cooperative elements of a lockable interconnection within said passageway of said switch casing and on said wire terminal for lockably retaining said wire terminal within said passageway of said switch casing when said wire terminal is slidably inserted therein;

(d) said wire terminal having a planar body portion with a resiliently deflectable latching lug extending from one of the side edges thereof and having a pair of tabs extending laterally and oppositely from said planar body portion;

(e) a latching ledge integral with said switch casing and having a latching surface, said latching ledge extending into said passageway of said switch casing, said latching ledge exerting a deflecting force on said latching lug of said wire terminal during slidable insertion thereof into said passageway and removing that deflecting force when said wire terminal is fully inserted therein to allow said latching lug of said wire terminal to resiliently move into latching engagement with the latching surface of said latching ledge and lockably retain said wire terminal within said passageway;

(f) said passageway of said switch casing having opposed sidewalls and a pair of elongated guide channels, each guide channel being formed in a corresponding opposed sidewall and disposed to open inwardly into said passageway, said pair of guide channels each disposed to receive a different opposite side edge of said planar body portion of said wire terminal for guiding movement of said wire terminal during insertion thereof and to subsequently prevent lateral movement of said wire terminal, said latching ledge being disposed in one of said pair of guide channels with each of said guide channels having stop means formed integral with said casing for bearing engagement with said respective tabs on said wire terminal to define the fully inserted position of said wire terminal in said passageway; and (g) switch actuating means having a movable operating means disposed within said cavity of said switch casing and movable into and out of electrically conductive contact with said switch contact portion of said wire terminal when said wire terminal is inserted into said passageway of said switch casing and maintained therein.

4. An electric switch for receiving at least one terminal which couples said electric switch into an electric circuit, said switch having a bridging contact which provides a switch contact within said electric switch, said latter comprising:

(a) a switch casing having a cavity and at least one passageway which extends from the periphery of said switch casing and opens into said cavity;

(b) a terminal with a body portion one end of which defines a switch contact portion having an end face thereon for engagement by said bridging contact, and said terminal being slidably insertable into said passageway of said switch casing from outside said periphery of said switch casing to a position which places said switch contact portion thereof within said cavity of said switch casing, said passageway and said terminal having cooperative elements of a lockable interconnection for lockably retaining said terminal within said passageway in a position such that said end face of said switch contact portion is within said switch casing cavity such that an electrical and physical connection can be made between such end face of said switch contact portion and said bridging contact;

(c) said cooperative elements of said passageway and said terminal comprising means in said passageway and means on said terminal body portion to cooperatively interact to limit the insertion of said terminal into said passageway and to lock said terminal in a fully inserted position in said passageway at said limit of said insertion;

(d) switch actuating means operatively coupled to said bridging contact, which latter is within said cavity of said switch casing, said bridging contact having a contact face on one side thereof positioned generally at right angles to the retained position of said terminal adapted to be moved into and out of electrical contact with said end face of said terminal when said terminal is fully inserted into and lockably retained in said passageway;

(e) with said cooperative elements of said passageway and said terminal further comprising a resiliently deflectable latching member integral with said switch casing and disposed within said passageway; and (f) a latching lug on said terminal and moving therewith exerting a deflecting force on said latching member when said terminal is being slidably inserted into said passageway and removing that deflecting force from said latching member upon full insertion of said terminal at which latter position said latching member resiliently moves into latching engagement with said latching lug and locks said terminal in said passageway;

(g) with said resiliently deflectable latching member comprising a cross member integral with said switch casing and extending part way across the point where said passageway opens into said switch casing cavity; and (h) said latching member extends from said cross member in cantilever fashion axially into said passageway and includes therewith a bight portion which moves into latching engagement with said latching lug upon full insertion of said terminal into said passageway.

5. An electric switch for receiving at least one terminal which couples said electric switch into an electric circuit, said switch having a bridging contact which provides a switch contact within said electric switch, said latter comprising:

(a) a switch casing having a cavity and at least one passageway which extends from the periphery of said switch casing and opens into said cavity;

(b) a terminal with a body portion one end of which defines a switch contact portion having an end face thereon for engagement by said bridging contact, and said terminal being slidably insertable into said passageway of said switch casing from outside said periphery of said switch casing to a position which places said switch contact portion thereof within said cavity of said switch casing, said passageway and said terminal having cooperative elements of a lockable interconnection for lockably retaining said terminal within said passageway in a position such that said end face of said switch contact portion is within said switch casing cavity such that an electrical and physical connection can be made between such end face of said switch contact portion and said bridging contact;

(c) said cooperative elements of said passageway and said terminal comprising means in said passageway and means on said terminal body portion to cooperatively interact to limit the insertion of said terminal into said passageway and to lock said terminal in a fully inserted position in said passageway at said limit of said insertion;

(d) switch actuating means operatively coupled to said bridging contact, which latter is within said cavity of said switch casing, said bridging contact having a contact face on one side thereof positioned generally at right angles to the retained position of said terminal adapted to be moved into and out of electrical contact with said end face of said terminal when said terminal is fully inserted into and lockably retained in said passageway;

(e) with said cooperative elements of said passageway and said terminal further comprising a resiliently deflectable latching member integral with said switch casing and disposed within said passageway; and (f) a latching lug on said terminal and moving therewith exerting a deflecting force on said latching member when said terminal is being slidably inserted into said passageway and removing that deflecting force from said latching member upon full insertion of said terminal at which latter position said latching member resiliently moves into latching engagement with said latching lug and locks said terminal in said passageway;

(g) with said terminal having a planar body portion from which said latching lug extends normally and having a bifurcated end defined by a recessed opening between a pair of arms which provide the switch contact portion of said terminal; and (h) said switch casing having stop means formed integrally therein and disposed to span said passageway adjacent the point where it opens into said cavity, said stop means for bearing engagement with the recessed opening provided in the bifurcated end of said terminal to define the fully inserted position thereof.

6. An electric switch for receiving at least one terminal which couples said electric switch into an electric circuit, said switch having a bridging contact which provides a switch contact within said electric switch, said latter comprising:

(a) a switch casing having a cavity and at least one passageway which extends from the periphery of said switch casing and opens into said cavity;

(b) a terminal with a body portion one end of which defines a switch contact portion having an end face thereon for engagement by said bridging contact, and said terminal being slidably insertable into said passageway of said switch casing from outside said periphery of said switch casing to a position which places said switch contact portion thereof within said cavity of said switch casing, said passageway and said terminal having cooperative elements of a lockable interconnection for lockably retaining said terminal within said passageway in a position such that said end face of said switch contact portion is within said switch casing cavity such that an electrical and physical connection can be made between such end face of said switch contact portion and said bridging contact;

(c) said cooperative elements of said passageway and said terminal comprising means in said passageway and means on said terminal body portion to cooperatively interact to limit the insertion of said terminal into said passageway and to lock said terminal in a fully inserted position in said passageway at said limit of said insertion;

(d) switch actuating means operatively coupled to said bridging contact, which latter is within said cavity of said switch casing, said bridging contact having a contact face on one side thereof positioned generally at right angles to the retained position of said terminal adapted to be moved into and out of electrical contact with said end face of said terminal when said terminal is fully inserted into and lockably retained in said passageway;

(e) with said terminal having a planar body portion with side edges and with a resiliently deflectable latching lug extending from one of said side edges; and (f) a latching ledge integral with said switch casing and having a latching surface, said latching ledge exerting a deflecting force on said latching lug during slidable insertion of said terminal into said passageway, and with said deflecting force being removed when said terminal is fully inserted in said passageway whereby said latching lug resiliently moves into latching engagement with said latching surface of said latching ledge.

* * * * *